US010315443B2

(12) United States Patent
Tokai et al.

(10) Patent No.: US 10,315,443 B2
(45) Date of Patent: Jun. 11, 2019

(54) ASSISTANCE FEATURES FOR LOADING A MEDIUM INTO A PRINTING APPARATUS

(71) Applicant: SEIKO EPSON CORPORATION, Tokyo (JP)

(72) Inventors: Yoshitsugu Tokai, ShenZhen (CN); Hiroyuki Kobayashi, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/823,974

(22) Filed: Nov. 28, 2017

(65) Prior Publication Data

US 2018/0154661 A1 Jun. 7, 2018

(30) Foreign Application Priority Data

Dec. 2, 2016 (JP) ..... 2016-234740

(51) Int. Cl.

| | |
|---|---|
| ***B41J 11/00*** | (2006.01) |
| ***B41J 11/64*** | (2006.01) |
| ***B41J 15/04*** | (2006.01) |
| ***B41J 25/20*** | (2006.01) |
| ***B41J 15/16*** | (2006.01) |
| ***B41J 13/02*** | (2006.01) |

(52) U.S. Cl.

CPC ..... *B41J 15/042* (2013.01); *B41J 11/009* (2013.01); *B41J 11/0095* (2013.01); *B41J 11/64* (2013.01); *B41J 13/025* (2013.01); *B41J 15/046* (2013.01); *B41J 15/048* (2013.01); *B41J 15/165* (2013.01); *B41J 25/20* (2013.01)

(58) Field of Classification Search

CPC .... B41J 15/042; B41J 11/0095; B41J 13/025; B41J 15/165; B41J 11/009; B41J 25/20; B41J 15/048; B41J 15/046; B41J 11/64

See application file for complete search history.

(56) References Cited

U.S. PATENT DOCUMENTS

2016/0272452 A1* 9/2016 Tokai ..... B65H 20/02

FOREIGN PATENT DOCUMENTS

| | | | |
|---|---|---|---|
| JP | 2004-066654 | A | 3/2004 |
| JP | 2009-166403 | A | 7/2009 |
| JP | 2011-011889 | A | 1/2011 |
| JP | 2016-175762 | A | 10/2016 |

* cited by examiner

*Primary Examiner* — Henok D Legesse
(74) *Attorney, Agent, or Firm* — Workman Nydegger

(57) ABSTRACT

A printing device includes a printing apparatus that includes a transport unit including a roller pair that nips and transports a medium, a printing unit that prints on the medium and a first sensor that detects the medium or a mark at a position downstream of the roller pair. The printing device also includes a first motor capable of driving the roller pair to a non-nipping state and to a nipping state, and a controller that controls the transport unit and the first motor so as to perform an assistance operation to assist setting of the medium. The assistance operation performed by the controller. When the first sensor detects the medium or the mark, the controller causes the medium to be nipped by the roller pair, and a skew correction operation in which the medium is transported and reverse transported is performed.

6 Claims, 9 Drawing Sheets

ASSISTANCE FEATURES FOR LOADING A MEDIUM INTO A PRINTING APPARATUS

CROSS-REFERENCE TO RELATED APPLICATIONS

The present application claims priority to Japanese Patent Application No. 2016-234740, filed Dec. 2, 2016, which is hereby incorporated by reference in its entirety.

BACKGROUND

1. Technical Field

Embodiments of the present invention relate to a printing apparatus including a transport unit in which a user manually sets a medium into a roller pair.

2. Related Art

One type of printing apparatus includes, for example, a transport device. A roll body wound with a medium (roll-form medium) may be mounted on the printing apparatus such that the medium can be supplied to the printing apparatus. The transport device transports the medium, which is fed out from the roll body, toward a printing region where a printing unit performs printing on the medium (for example, JP-A-2009-166403 and JP-A-2011-11889). After a roll body has been replaced, a user performs a setting (or loading) operation to set (or load) the medium in a transport unit by manually pulling the leading end portion of the medium out from the roll body and inserting the leading end portion into a roller pair of a transport unit.

For example, JP-A-2009-166403 describes a printing apparatus (a continuous paper printing apparatus) that includes a first printing device for printing the front face or side of the medium and a second printing device for printing the back face or side of the medium. In this printing apparatus, if a setting operation is performed prior to starting printing the front face, printing may proceed with only a small number of setting operations because no setting operation is performed to reset the medium of a roll body in the middle of front face printing and back face printing. However, this is a large printing system, and the second printing device for printing the back face of the medium is unnecessary for users who do not need to print on the back face of the medium. However, in the printing apparatus described, for example, in JP-A-2011-11889, a common printing unit needs to be employed when printing on the front face and when printing on the back face of a medium fed out from a roll body. In such cases, a user needs to perform a setting operation to reset the medium of a roll body in a transport unit after printing on the front face and before printing on the back face, resulting in a larger relative number of setting operations. In this manner, setting operations to set a medium into a roller pair are performed in printing apparatuses such as those described in JP-A-2009-166403 and JP-A-2011-11889, although the frequency (number of times) thereof differ.

A setting operation, in which a user pulls a leading end portion of a medium out from a roll body and sets the leading end portion into a roller pair, is performed in a non-nipping state in which the pair of rollers do not nip the medium and there is a gap between the pair of rollers. In the setting operation, the medium slips out from the gap between the pair of rollers if the user takes their hands away from the medium during the setting operation. In order to avoid such a situation, a user needs to press or hold the medium with one hand, while using their other hand to arrange the medium and operate an operation lever to open/close the pair of rollers.

This type of a medium setting operation is a troublesome operation. In particular, for example, in a large printing apparatus for printing large size medium, the roll body is heavy. Thus, there is a heavy operational burden in the setting operation to pull the medium out from the roll body. Moreover, in such printing apparatuses, a skew correction operation is performed to correct any skew (angle) of the medium prior to starting printing. Because the skew correction operation is performed while a transport operation to transport the medium in a transport direction is performed, a waiting time is caused from when the user performs a print start instruction operation to when printing of images on the medium is started. These problems are not limited to printing apparatuses that employ roll bodies, and are roughly the same for printing apparatuses in which sheet medium, such as cut paper, is set into a roller pair in a transport unit.

SUMMARY

An advantage of some aspects of embodiments of the invention is the provision of a printing apparatus capable of smooth operation from when a user sets a medium into a roller pair in a transport unit to when printing is started.

The following relates to the way in which the above issues are addressed and the advantageous effects thereof.

According to an aspect of the invention, a printing apparatus includes a transport unit, a printing unit, a detection unit, a drive unit, and a controller. The transport unit transports a medium that is nipped by a roller pair in a transport direction. The printing unit prints on the medium at a position downstream of the roller pair in the transport direction. The detection unit detects the medium at a position downstream of the roller pair in the transport direction using either the medium or a mark applied to the medium as a detection target. The drive unit is capable of driving the roller pair to a non-nipping state and a nipping state. In the non-nipping state, there is a gap open in or between the roller pair and the roller pair is not capable of nipping the medium. In the nipping state, the roller pair is capable of nipping the medium. The controller controls at least the transport unit and the drive unit so as to perform an assistance operation to assist in setting the medium in the transport unit. The assistance operation performed by the controller includes a nipping operation in which, from the non-nipping state of the roller pair, the detection unit detects the medium and the roller pair is driven to the nipping state to cause the medium to be nipped by the roller pair. The assistance operation may also include a skew correction operation following on from the nipping operation, in which rotation of the roller pair is controlled and the medium is transported downstream in the transport direction and the medium is transported upstream in the transport direction.

According to such configuration, the user inserts the medium into the gap of the roller pair provided in the transport unit. When, from the non-nipping state in which there is a gap open in or between the roller pair, the detection unit detects the medium using either the medium or the mark applied to the medium as the detection target, and the controller performs the nipping operation to nip the medium with the roller pair by driving the roller pair to the nipping state. In other words, when the medium is detected in the gap, the roller pair is changed from the non-nipping state to the nipping state.

Following on therefrom, the controller performs a skew correction operation to correct any skew (angle) of the medium by transporting the medium downstream in the transport direction and reverse transporting the medium upstream in the transport direction.

Therefore, according to the assistance operation that includes the nipping operation and the skew correction operation, in addition to making operations for a user to set the medium in the transport unit easier, printing can be started quickly after the medium setting operation due to the assistance operation, which includes the skew correction operation. This thereby enables the user to smoothly perform operations from setting of the medium in the roller pair of the transport unit up to the point of starting printing.

In the above printing apparatus, in cases in which the detection unit is configured by a first detection unit, a second detection unit that detects a width direction end portion of the medium in a printing region may be included. The controller causes the width direction end portion of the medium to be detected by the second detection unit after the medium has been transported upstream in the transport direction.

According to the above configuration, the second detection unit detects the width direction end portion of the medium after the medium has been transported upstream in the transport direction. Detection of the width direction end portion of the medium is performed after the skew correction operation. This enables the position of the width direction end portion of the medium to be detected comparatively more accurately during printing.

In the above printing apparatus, based on a position of the width direction end portion of the medium detected by the second detection unit, the controller determines a position in the width direction of a printing region where the printing unit will print on the medium.

According to the above configuration, the controller determines the position in the width direction of the printing region where the printing unit will print on the medium based on the position of the width direction end portion of the medium detected by the second detection unit. The ability to suppress positional misalignment in the width direction of the printing region where the medium M will be printed enables printing to be performed with a comparatively high positional precision.

In the above printing apparatus, after the medium has been transported downstream in the transport direction during the skew correction operation, the controller determines a stop position for the medium for when the medium is transported upstream in the transport direction based on a detection result in which the mark is detected by the detection unit. In one example, transport of the medium in the upstream direction during the skew operation stops when the mark is detected.

For example, in a configuration in which the medium is transported upstream until an end portion (leading end) of the medium is detected, there is a tendency for the medium to be returned or transported too far upstream. As a result, the amount to transport the medium from the stop position (when the leading end is detected) to the print start position tends to be a relatively large amount.

In contrast, when the above configuration is adopted, the stop position for stopping the upstream transport when the medium is transported upstream in the transport direction is determined based on the detection results of the mark. For example, after completing the skew correction operation where a stop position is determined, it is possible to achieve a relatively small transport amount of the medium from the stop position to the print start position, or to eliminate this transport amount, while avoiding a situation where the medium is returned or transported too far upstream. This enables printing to be started comparatively soon after completing the skew correction operation. Printing can be started comparatively soon because embodiments of the invention can minimize or reduce the distance between the stop position and the printing position.

A roll-form medium support capable of supporting a roll-form medium wound with pre-printing medium may be included in the printing apparatus and the controller may perform the assistance operation when the detection unit detects the medium or the mark in a state in which the roller pair is in the non-nipping state and the roll-form medium support is being rotated.

According to the above configuration, the assistance operation is started upon detection of a rotating state of the roll-form medium support, in addition to detection of the medium or the mark by the detection unit, as a trigger. This enables a situation to be avoided in which the assistance operation is started due to the detection unit mistakenly detecting the hand of the user or the like.

A roll-form medium support capable of supporting a roll-form medium wound with pre-printing medium may be included in the printing apparatus. The printing apparatus may also include a drive source that rotates the roll-form medium support, and a third detection unit that detects load in a rotation direction or rotation of the roll-form medium. The controller may drive the drive source and feed the medium out from the roll-form medium when the third detection unit detects load in the rotation direction or rotation of the roll-form medium while the drive source is in a non-driven state.

According to the above configuration, the controller drives the drive source and feeds the medium out from the roll-form medium when the third detection unit detects load in the rotation direction or rotation of the roll-form medium. The user is thereby assisted by the rotational driving of the roll-form medium support even when the user is pulling the medium out from the roll-form medium in order to set the medium in the roller pair. This enables the burden of the operation to set the medium or the burden of the setting operation on a user to be reduced.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

First Embodiment

A first embodiment of a printing apparatus is described as follows, with reference to the drawings. The printing apparatus is, for example, a large format printer that prints (records) on a large size, elongated medium.

Figure 1:
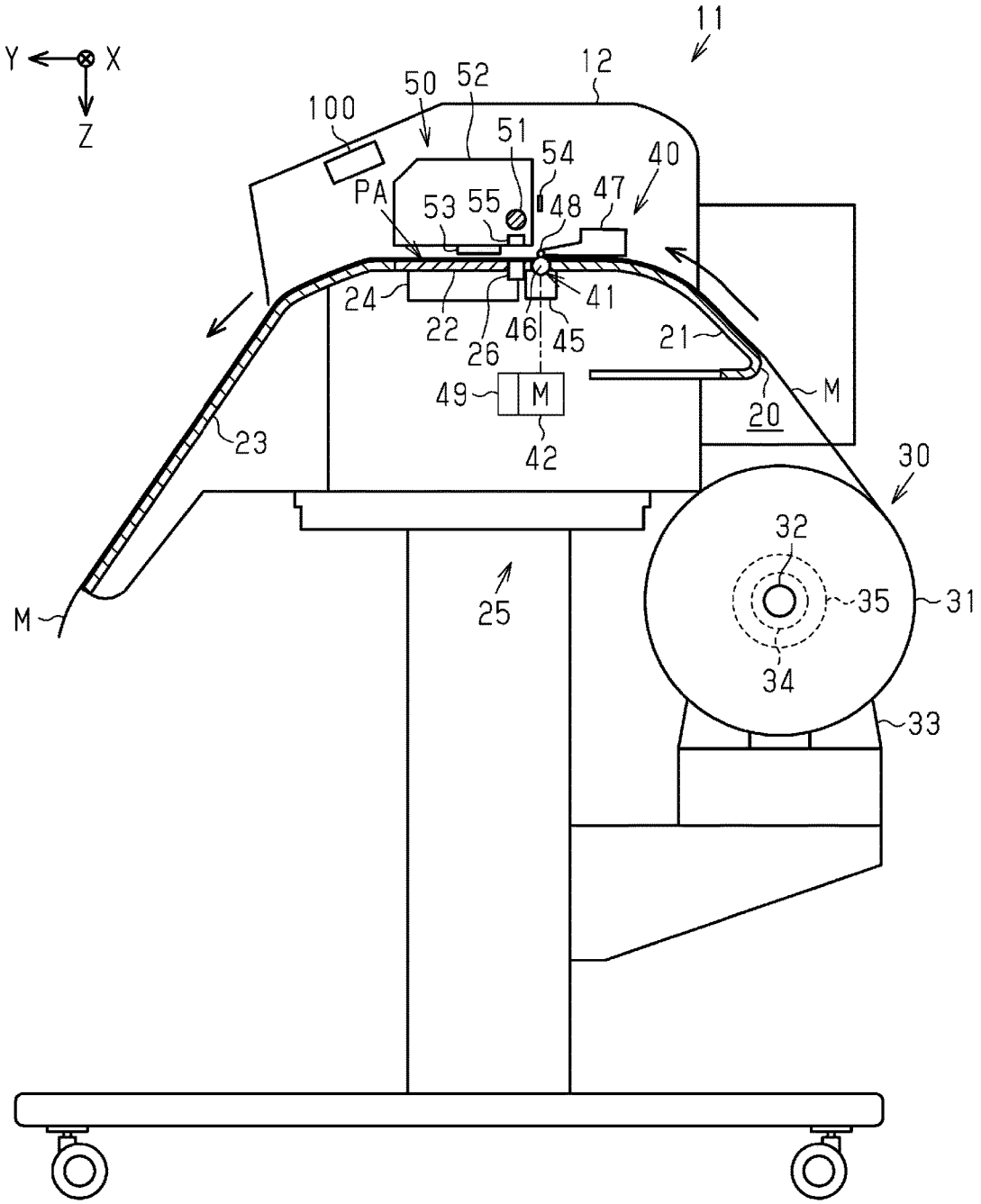
FIG. 1 is a schematic cross-section illustrating a printing apparatus of a first embodiment.

As illustrated in FIG. 1, a printing apparatus 11 includes a case 12, a support unit 20 to support a medium M, a transport device 25 to transport the medium M in the direction indicated by the arrow in FIG. 1, and a printing unit 50 to print on the medium M inside the case 12.

In the following description, a direction along the width direction of the medium M and orthogonal to the length direction of the medium M (a direction orthogonal to the page in FIG. 1) is a scanning direction X, and a direction in which the medium M is transported at a position where printing is performed by the printing unit 50 is a transport direction Y. In the present embodiment, the scanning direction X and the transport direction Y are mutually intersecting directions (preferably orthogonally), and are directions intersecting (preferably orthogonally) the direction of gravity Z. Note that the scanning direction is also sometimes called width direction X.

As illustrated in FIG. 1, the support unit 20 includes a first support 21, a second support 22, and a third support 23 forming a transport path for the medium M. A suction mechanism 24 is disposed below the second support 22. The first support 21 has an inclined face that is sloped so as to be higher at the downstream side than at the upstream side in the transport direction Y. The second support 22 is provided at a position facing the printing unit 50, and supports the medium M during printing. The third support 23 has an inclined face that is sloped so as to be lower at the downstream side than at the upstream side in the transport direction Y, and guides the medium M that has been printed on by the printing unit 50.

The second support 22 includes plural non-illustrated suction holes in a support face to support the medium M. The medium M being printed on is suppressed from lifting up by driving the suction mechanism 24 and suctioning the medium M as it passes over the suction holes. Moreover, contact between a liquid ejection section 53 of the printing unit 50 and the medium M due to the medium M lifting up is also suppressed by driving the suction mechanism 24 while transporting the medium M.

Figure 2:
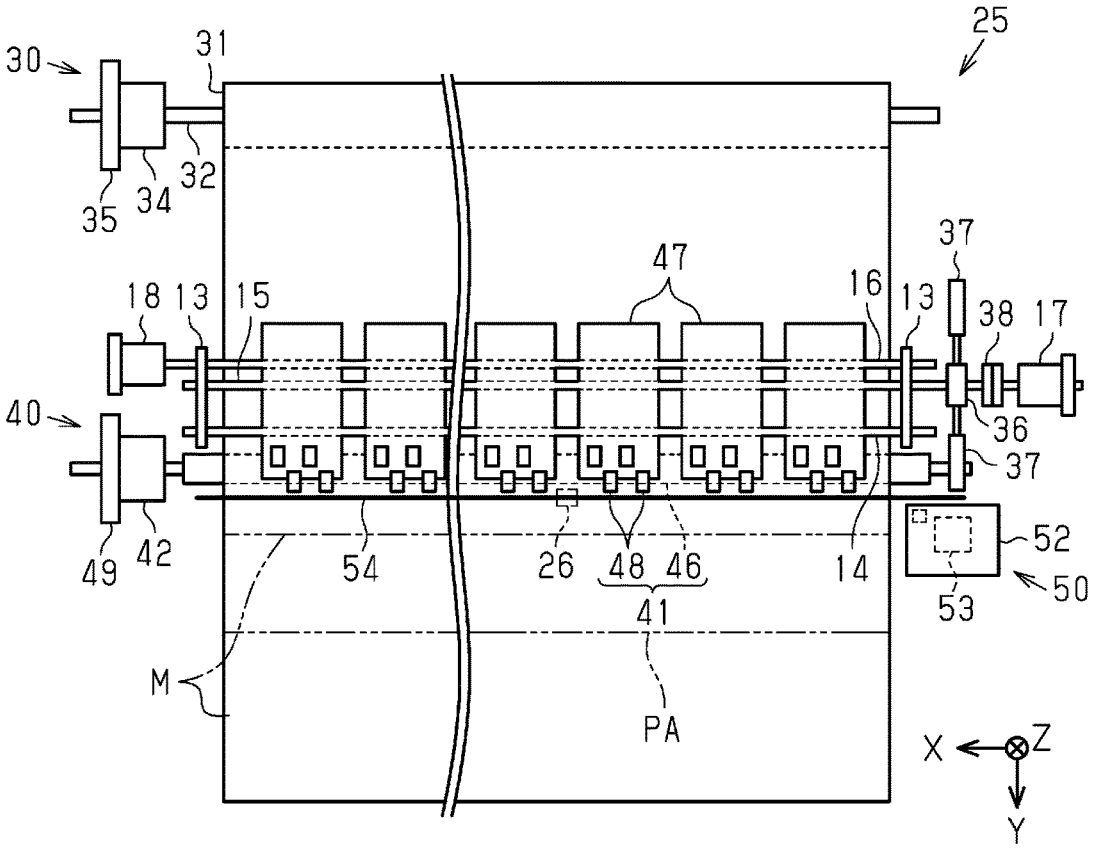
FIG. 2 is a schematic plan view illustrating a printing apparatus.

As illustrated in FIG. 1 and FIG. 2, the printing unit 50 prints the medium M at a position that is further downstream in the transport direction Y than a roller pair 41. The printing unit 50 includes the liquid ejection section 53 to eject ink onto the medium M in a printing region PA. The printing unit 50 employs, for example, a serial printing method, and includes a carriage 52 capable or moving to-and-fro along the scanning direction X. The carriage 52 is moved to-and-fro in the scanning direction X and along a guide shaft 51 spanning across inside the case 12 by drive from a non-illustrated carriage motor. The liquid ejection section 53 is fixed to the carriage 52 in a state facing the medium M supported by the second support 22. The printing unit 50 then performs a printing operation to form text or images on the medium M by ejecting ink from the liquid ejection section 53 while moving along the scanning direction X of the carriage 52. As illustrated in FIG. 1, the printing apparatus 11 includes the transport device 25, and a controller 100 to control the printing unit 50, provided, for example, inside the case 12. Note that the printing unit 50 may employ a line printing method. In such cases, a line printing method liquid ejection section 53 having an elongated shape slightly longer than the maximum media width in width direction X is disposed so as to extend along the width direction X, and a printing operation is performed by ejecting ink onto the medium M as the medium M is being transported at a fixed speed.

Details will now be given regarding the configuration of the transport device 25. As illustrated in FIG. 1 and FIG. 2, the transport device 25 includes a feeder 30 to feed the medium M, and a transport unit 40 to transport the medium M fed in from the feeder 30 along the transport direction Y. The feeder 30 includes a holder 33 (see FIG. 1) and a feed motor 34. The holder 33 includes a roll-form medium support 32 to rotatably support a roll body 31, which serves as an example of a roll-form medium of the medium M wound into a roll shape. The feed motor 34 outputs motive force to rotate the roll body 31 in two directions, either a feed direction (the anti-clockwise direction in FIG. 1), or a return direction (the clockwise direction in FIG. 1). The feeder 30 further includes a rotary encoder 35 capable of detecting the rotation direction and the rotation amount of the roll body 31.

The holder 33 illustrated in FIG. 2 is configured so as to be capable of holding plural types of the roll body 31 that differ in length (width) along the width direction X and/or in numbers of turns. The feeder 30 is capable of performing a feed operation, in which the medium M is fed toward a drive roller 46 by rotating the roll body 31 in the feed direction, and a winding operation to pull the medium M back in the return direction, which is the opposite direction to the transport direction Y so as to take the medium M up on the roll body 31 by rotating the roll body 31 in the return direction.

The transport unit 40 includes the roller pair 41. The roller pair 41 is configured to nip the medium M and to transport the medium M along the transport direction Y. The transport unit 40 may include a transport motor 42 to impart motive force to the medium M so as to transport the medium M with the roller pair 41. The roller pair 41 may be, for example, provided between the first support 21 and the second support 22 in the transport direction Y. The roller pair 41 is disposed such that the axial direction of the rollers in the roller pair 41 extends along the scanning direction X.

The roller pair 41 is formed as a pair of rollers (the following rollers may include multiple physically separated rollers) configured by the drive roller 46 supported by a support table 45 and following rollers 48 supported by modifier units 47. By driving the transport motor 42, the drive roller 46 rotates in a forward rotation direction (the anti-clockwise direction in FIG. 1) to transport the medium M downstream in the transport direction Y, or a reverse rotation direction (the clockwise direction in FIG. 1) to return the medium M upstream in the transport direction Y. The transport device 25 includes a rotary encoder 49 to detect the rotation direction and the rotation amount of the drive roller 46.

In the roller pair 41, the drive roller 46 and the following rollers 48 nip the medium M by the following rollers 48 pressing the medium M against the drive roller 46. The modifier units 47 modify the pressing force of the following rollers 48 against the drive roller 46. The medium M is then transported along the transport direction Y by rotating (for example, forward rotating) the drive roller 46 in a state in which the medium M is nipped by the roller pair 41.

As illustrated in FIG. 1 and FIG. 2, a first sensor 26, serving as an example of a detection unit to detect the medium M using either the medium M or marks 90 applied to the medium M (see FIG. 7) as a detection target, is provided at a position further downstream in the transport direction Y than the roller pair 41. The first sensor 26 is, for example, embedded in a medium support face of the second support 22 in a state in which a detection portion of the first sensor 26 is exposed. The sensor 26 is configured to output a detection signal when detecting the medium M and to output a non-detection signal when not detecting the medium M. Moreover, a second sensor 55, serving as an example of a second detection unit to detect a width direction X end portion (edge) in the printing region PA, is provided to the carriage 52.

In one embodiment, the first sensor 26 is disposed inside the printing region PA at a position further downstream than the roller pair 41 in the transport direction Y. In particular, the first sensor 26 may disposed at a position further upstream than the liquid ejection section 53 in the transport direction Y. The first sensor 26 also doubles as a medium detection unit to detect the leading end portion of the medium M in the transport direction Y during printing when the medium M is disposed at the print start position in the transport direction Y. Note that the first sensor 26 and the medium detection unit may be provided separately. In such cases, the first sensor 26 may be disposed inside the printing region PA. In the present embodiment, the printing region PA means a region further downstream than the roller pair 41 in the transport direction Y, and is a region where the support unit 20 is present to support the medium M. Moreover, in a narrow definition, as illustrated in FIG. 2, the printing region PA means a region extending to the furthest limit on the downstream side of the region where the medium M to be printed on is present inside the case 12. The printing region PA where the first sensor 26 is disposed is not limited to the liquid ejection region where the liquid ejection section 53 ejects ink toward the medium M, and further includes a region for fixing ink that has landed on the medium M, such as by drying.

As illustrated in FIG. 2, plural (for example, 20) modifier units 47 are provided along the scanning direction X in a state in which the modifier units 47 are supported so as to be capable of swinging about a support shaft 14 bridging between a pair of support frames 13 provided at the outside of the transport path of the medium M. The support shaft 14 extends in the X direction. A single modifier unit 47 rotatably supports one or more (four in the example of FIG. 2) of the following rollers 48. Note that the number of modifier units 47 and the number of the following rollers 48 supported by each of the modifier units 47 may be varied as appropriate.

A release shaft 15 is supported so as to be capable of swinging by the support frames 13 at a position further upstream than the support shaft 14 in the transport direction Y. The release shaft 15 extends in the X direction. An adjustment shaft 16, which also extends in the X direction, is supported so as to be capable of swinging by the support frames 13 at a position further upstream in the transport direction Y than the release shaft 15. The release shaft 15 serves as an example of a drive unit and is rotated by the drive force of a first motor 17 (see also FIG. 6). Moreover, the adjustment shaft 16 is rotated by the drive force of a second motor 18 (see also FIG. 6) that acts as the drive source of the adjustment shaft 16.

As illustrated in FIG. 2, an operation lever 37 (release lever) is provided at one end of the release shaft 15 through a mechanism 36, such as a link mechanism. The end of the release shaft 15 that passes through the mechanism 36 is coupled to an output shaft of the first motor 17 through an electromagnetic clutch 38 in one example. The electromagnetic clutch 38 is connected when the first motor 17 is driving or operating, and is disconnected at other times. Essentially, because the first motor 17 is driven when there is no need for the user to operate the operation lever 37, the electromagnetic clutch 38 adopts or is placed in a disconnected state when a user operates the operation lever 37, such that the operation lever 37 can be operated by a comparatively small operation force. Note that in embodiments of the invention, for example as illustrated in FIG. 2, one operation lever 37 is provided at each of the front and rear sides of the printing apparatus 11.

Figure 3:
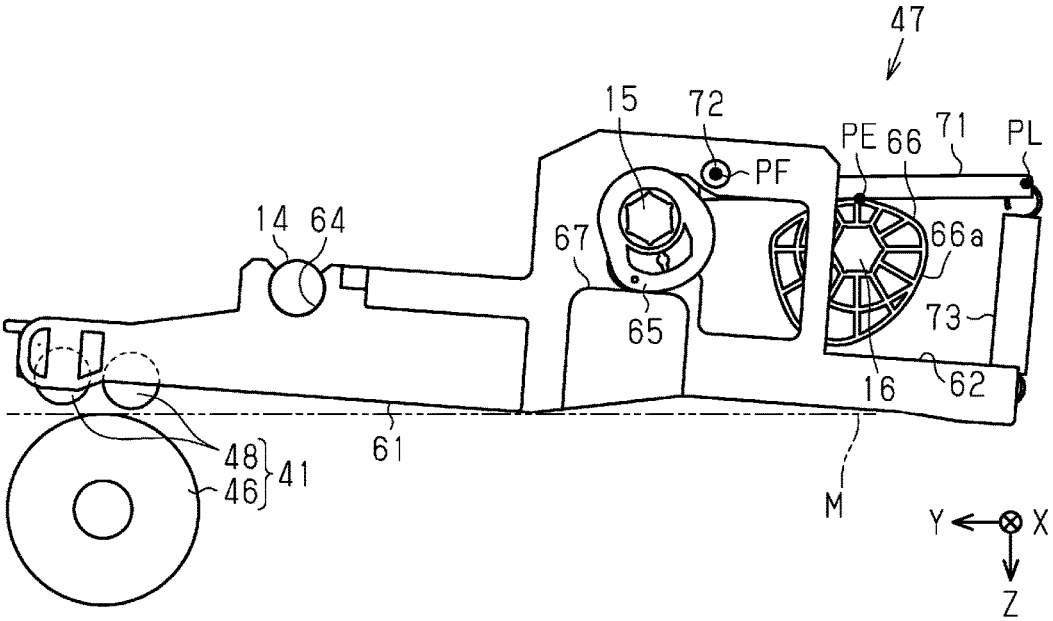
FIG. 3 is a schematic side view illustrating a modifier unit when a roller pair is in a non-nipping state.

As illustrated in FIG. 3, the modifier units 47 each include a spring 73 that is extended so as to generate pressing force, a swing member 61 attached to the support shaft 14 through an engagement recess 64 so as to be capable of swinging, an arm member 71 having a base end that is supported so as to be capable of swinging with respect to the swing member 61, a first cam 65 (release cam) attached to the release shaft 15, and a second cam 66 (adjustment cam) attached to the adjustment shaft 16.

The swing member 61 rotatably supports the following rollers 48 at the downstream end of the swing member 61 in the transport direction Y, and the swing member 61 is supported so as to be capable of swinging about the support shaft 14 in a state in which a first end (lower end) of the spring 73 is anchored by an extension section 62 provided at the upstream end of the swing member 61 in the transport direction Y. Note that the following rollers 48, in one embodiment, are arranged such that their rotational axes form two rows having different positions in the transport direction Y. The following rollers 48 are, for example, mounted to the base end of the swing member 61 in a staggered array pattern.

A base end of the arm member 71 (the left end in FIG. 3) is supported through a pin 72 provided at a position between the engagement recess 64 and the second cam 66 in the transport direction Y, which is also the length direction of the swing member 61, such that the arm member 71 is supported in a rotatable state with respect to the swing member 61. A second end (upper end) of the spring 73 is hooked onto a leading end of the arm member 71 (the right end in FIG. 3). Note that the arm member 71 is attached to the swing member 61 at a position above the extension section 62.

The swing member 61 includes an engagement section 67 capable of engaging with the first cam 65 at the base end side of the swing member 61, further upstream than the support shaft 14 in the transport direction Y. The first cam 65 is disposed either at the rotation angle illustrated in FIG. 3 or at the rotation angle illustrated in FIG. 4 by rotating the release shaft 15 with the drive force of the first motor 17. When the first cam 65 is at the rotation angle illustrated in FIG. 3, the roller pair 41 adopts a non-nipping state (released state) having a gap or space between the roller 26 and the following rollers 28. The roller pair 41 is not capable of nipping the medium M when in the non-nipping state. However, when the first cam 65 is at the rotation angle illustrated in FIG. 4, the roller pair 41 adopts a nipping state (gripping state) and is capable of nipping the medium M. In this manner, by rotating the first cam 65 together with release shaft 15 using the drive force of the first motor 17, the roller pair 41 is driven so as to switch between the non-nipping state in which a gap is opened, and the nipping state in which the roller pair 41 is closed and capable of nipping the medium M. Thus, the modifier unit 47 is arranged such that the first motor 17 can move the roller pair 41 from the nipping state to the non-nipping state and from the non-nipping state to the nipping state.

For example, in advance of the user setting the leading end portion of the medium M pulled out from the roll body 31 into the roller pair 41, the user operates (e.g., presses or lifts) the operation lever 37 from the nip operation position to the release operation position. Operating the operation lever 37 in this manner moves the following rollers 48 from the nipping position (nipping state) illustrated in FIG. 4 so as to dispose or place the following rollers 48 in the release position (non-nipping state) illustrated in FIG. 3. The roller pair 41 is thereby switched from the nipping state illustrated in FIG. 4 in which the roller pair 41 is closed to an extent that enables the medium M to be nipped, to the non-nipping state illustrated in FIG. 3 in which a gap is opened to enable the medium M to be inserted into the gap. The user then sets the medium M in the transport unit 40 by inserting the leading end portion of the medium M into the gap in the roller pair 41, while the roller pair is in the non-nipping state. Then, the leading end portion of the inserted medium M is nipped by the roller pair 41.

Due to the medium M being comparatively wide and being comparatively heavy, the medium setting operation is traditionally an operation that is both troublesome and has a heavy burden. The operation is troublesome and has a heavy burden because a user needs either to insert the medium M such that it drapes over the front side of the support unit 20, or to operate the operation lever 37 using one hand while handling the medium M with the other hand such that the inserted medium does not fall out from the gap in the roller pair 41 under its own weight. To address this, in the printing apparatus 11 of embodiments of the invention, an assistance operation is performed to assist the user-performed medium setting operation. Note that, in one example, what is referred to as the leading end portion of the medium M is a portion that needs to be inserted further downstream in the transport direction Y than the roller pair 41 in order to set the medium M. The leading end portion is normally a portion of a predetermined length within the range of, for example, from 3 cm to 100 cm from the leading edge. The range is not so limited however.

The mechanism to modify (adjust) the pressing force of the following rollers 48 pressing the medium M between the following rollers 48 and the drive roller 46 at the modifier units 47 will now be described with reference to FIG. 4 and FIG. 5. In one example, the following rollers 48 press the medium against the drive roller 46 with a pressing force.

In the present example, a tensile spring is employed as the spring 73. In particular, a tensile coil spring is preferably employed such that a force (initial tensile force=Nf) is maintained in a direction to press individual spring coils together even in an unloaded state. In such cases, the most compressed state of the spring 73 due to the initial tensile force is the natural length, and the spring 73 does not extend from the natural length so long as a load exceeding the initial tensile force is not applied thereto.

The second cam 66 includes a cam face 66*a* having a distance from the adjustment shaft 16 that continuously changes. The cam face 66*a* is disposed so as to make contact with a position between the base end and the leading end of the arm member 71. The arm member 71 swings such that the leading end of the arm member 71 is displaced about the pin 72 passing through the base end of the arm member 71 in a direction to extend or contract the spring 73 as a result of the contact position on the cam face 66*a* changing as the second cam 66 rotates. In other words, rotation of the cam 66 can result in extension or contraction of the spring 73.

When this occurs, the arm member 71 functions as a lever, in which the portion receiving the pressing force from the second cam 66 is a force application point PE, the base end of the arm member 71 is a pivot point PF, and the leading end of the arm member 71 is the point of action PL. In the arm member 71, the force application point PE is between the pivot point PF and the point of action PL, and displacement of the force application point PE results in an even larger displacement at the point of action PL, causing the spring 73 to extend.

Figure 4:
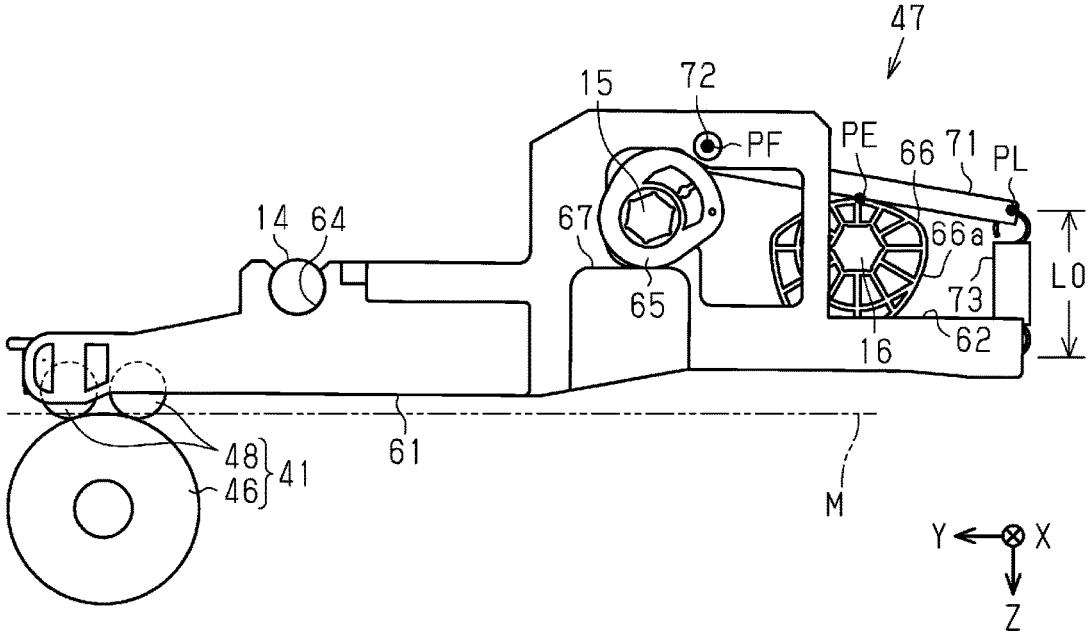
FIG. 4 is a schematic side view illustrating a modifier unit when a roller pair is in a nipping state with a first pressing force.
Figure 5:
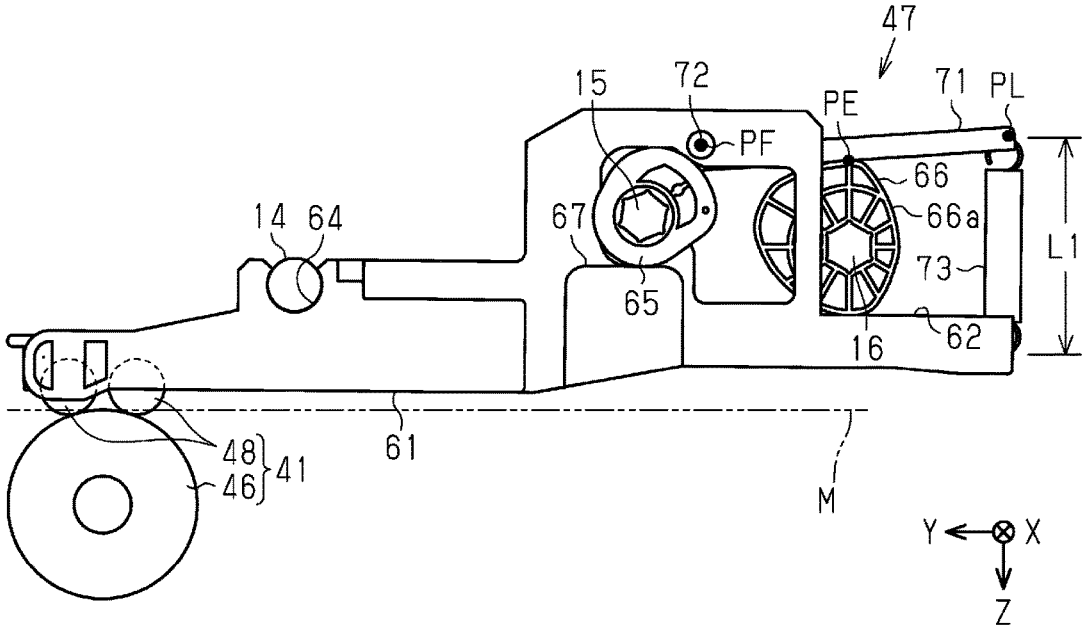
FIG. 5 is a schematic side view illustrating a modifier unit when a roller pair is in a nipping state with a second pressing force.

As illustrated in FIG. 4, when the following rollers 48 are in the nipping position, a pressing force is generated by the spring 73 being extended due to the arm member 71 receiving the pressing force of the second cam 66, and the following rollers 48 supported by the base end section of the swing member 61 press the medium M against the drive roller 46 below. In this manner, a biasing force associated with the spring 73 when the spring 73 has been extended produces the pressing force of the following rollers 48. The pressing force of the following rollers 48 becomes stronger as the length by which the spring 73 is extended increases. Namely, the more the spring 73 is extended by change in the rotation angle of the second cam 66, the stronger the nipping force with which the roller pair 41 nips the medium M.

From a state in which the following rollers 48 are in the nipping position, the length of the spring 73 changes in steps when the second cam 66 rotates and the rotation angle of the arm member 71 changes. For example, in one embodiment, the pressing force of the following rollers 48 is changed between two steps by changing the length of the spring 73 between two steps (L0<L1). Namely, when the length of the spring 73 changes between two steps, these being L0 (FIG. 4) and L1 (FIG. 5), the pressing force of the following rollers 48 is changed between two respective steps, these being N0 and N1 (N0<N1). In the present example, after a user has inserted the medium M being set in the transport unit 40 into the gap of the roller pair 41, the first pressing force N0 is employed by the roller pair 41 to nip the medium M that has been inserted, and to transport the nipped medium M prior to printing. Moreover, the second pressing force N1 is employed when the roller pair 41 nips the medium M to transport the medium M during printing. Note that in the following, the pressing force of the following rollers 48 is the pressing force against the drive roller 46, and is also referred to as the pressing force (nip force) of the roller pair 41.

Note that, the pressing force of the roller pair 41 may be adjusted in plural steps, this being three or more steps in one example, by changing the length of the spring 73 in plural steps, this being three or more steps, by adjusting the rotation angle of the second cam 66. In such cases, for example, the first pressing force N0 of the roller pair 41 may be adjusted according to the type of medium M when setting the medium. Moreover, the second pressing force N1 of the roller pair 41 may be adjusted according to the type of medium M when printing the medium.

For example, when the pressing force of the roller pair 41 is adjusted according to the type of medium M when setting the medium M in the transport unit 40, the pressing force may be adjusted as indicated below. For example, when the medium M is thin or has low stiffness, such as banner paper, the modifier units 47 may select a weak force from out of plural steps as the first pressing force N0 of the following rollers 48. Moreover, when, for example, the medium M is thick or has high stiffness, such as a polyvinyl resin film, the modifier units 47 may select a strong force from out of the plural steps as the first pressing force N0 of the following rollers 48. Moreover, when the medium M is a medium M having a thickness or stiffness intermediate to those above, then the modifier units 47 may select a force having an intermediate strength from out of the plural steps as the first pressing force N0 of the roller pair 41. Note that in cases in which the pressing force of the roller pair 41 is adjusted according to the type of the medium M during printing, for similar reasons, the pressing force of the roller pair 41 during printing is may also be adjusted according to the type of the medium M. For example, the thinner the thickness or the lower the stiffness of the medium M, the weaker the pressing force of the roller pair 41.

Figure 6:
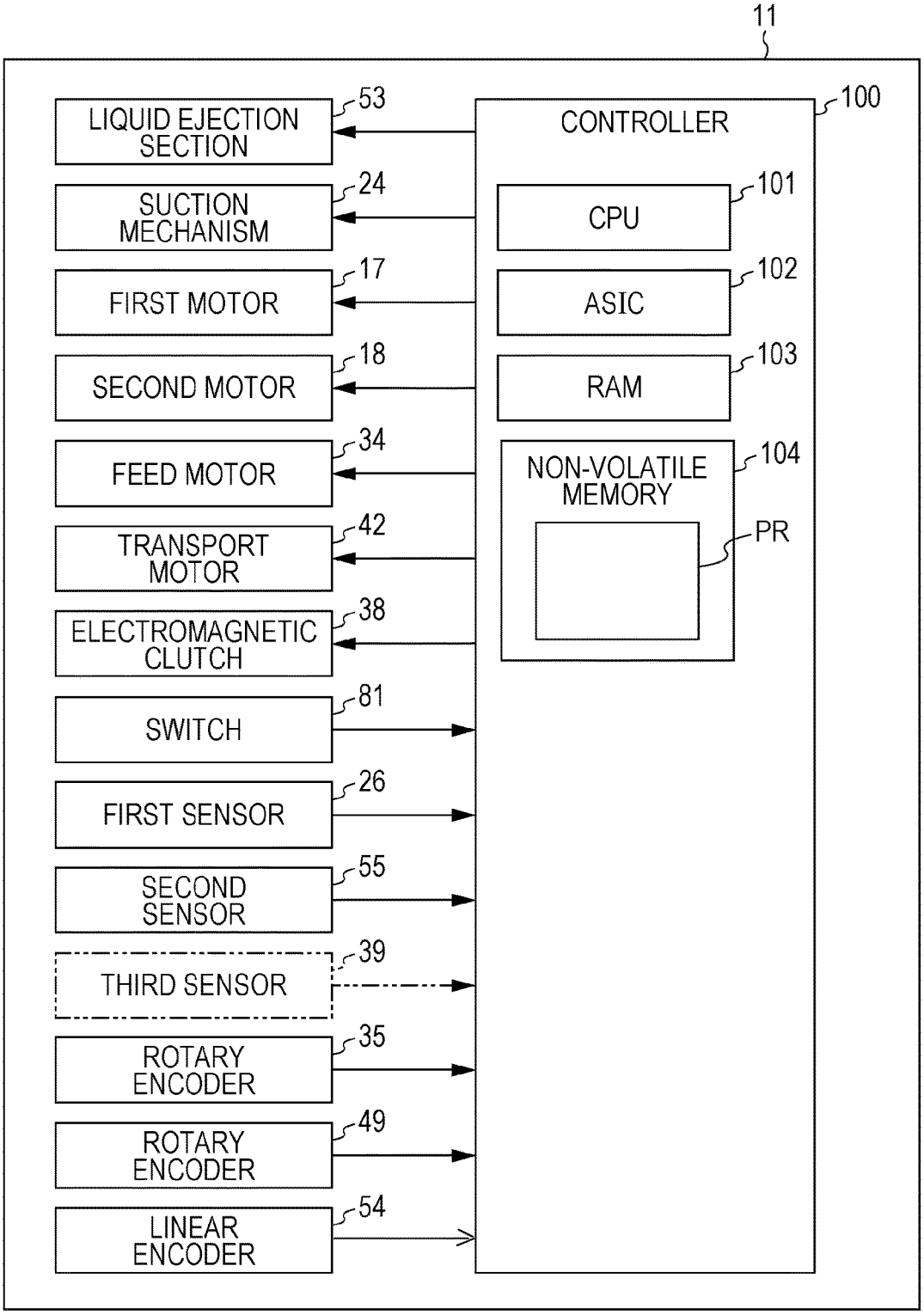
FIG. 6 is a block diagram illustrating an electrical configuration of a printing apparatus.

Description will now be given regarding an example electrical configuration of the printing apparatus 11, with reference to FIG. 6. As illustrated in FIG. 6, the controller 100 includes a CPU 101 (central processing unit), an ASIC 102 (application specific IC), RAM (Random Access Memory) 103, and non-volatile memory 104 serving as an example of a storage section. The liquid ejection section 53, the suction mechanism 24, the first motor 17, the second motor 18, the electromagnetic clutch 38, the feed motor 34, and the transport motor 42 are electrically connected to output terminals of the controller 100. The first sensor 26, the second sensor 55, the rotary encoders 35, 49, and a linear encoder 54 are electrically connected to input terminals of the controller 100. Description will now be given regarding a third sensor 39 of a third embodiment, described later.

Figure 8:
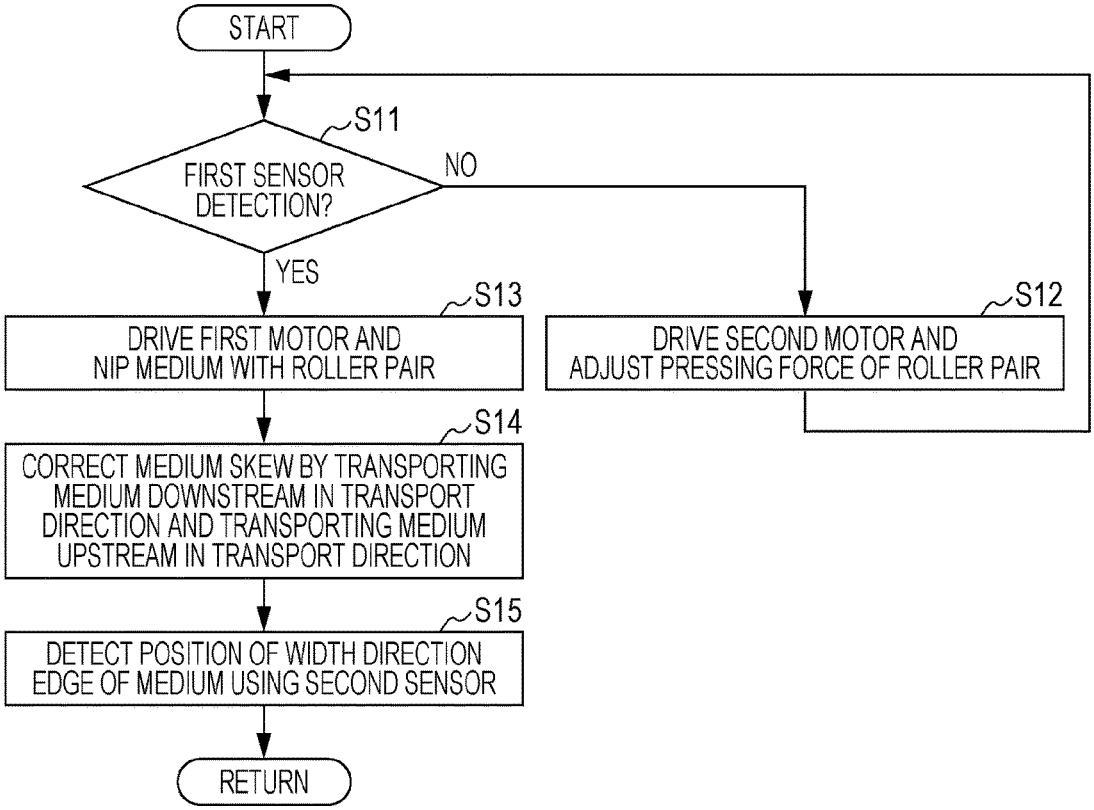
FIG. 8 is a flowchart illustrating medium setting assistance operation control.

Programs PR to control the liquid ejection section 53, the suction mechanism 24, the first motor 17, the feed motor 34, and the transport motor 42 are stored in the non-volatile memory 104. In the present example, a medium setting assistance operation control program, as illustrated in the flowchart of FIG. 8, is included as one of the programs PR. By executing the programs PR stored in the non-volatile memory 104, the controller 100 controls the liquid ejection section 53, the suction mechanism 24, and each of the motors 17, 18, 34, 42 on the basis of signals and the like from the sensors 26, 55 and the encoders 35, 49, 54.

For example, when the printing unit 50 is printing on the medium M, the controller 100 drives the suction mechanism 24 to suction the medium M, while also driving the transport motor 42 to transport the medium M in the transport direction Y. Moreover, in combination with the transport operation of the medium M, to transport the medium M the controller 100 also drives the feed motor 34 to feed the medium M out from the roll body 31. The controller 100 then prints images or the like on the medium M by controlling a liquid ejection timing of the liquid ejection section 53 in the intervals between intermittent transport of the medium M. Thus, when transporting the medium M in the transport direction Y and printing, the controller 100 controls the transport distance of the medium M based on the rotation amount of the drive roller 46 detected by the rotary encoder 49.

Moreover, when the user is setting the medium M in the transport unit 40, the controller 100 performs a medium setting assistance operation on the printing apparatus 11, this being an example of an assistance operation to assist setting of the medium M in the transport unit 40. When setting the medium M in the transport unit 40, the user operates or moves the operation lever 37 to the release operation position, the roller pair 41 adopts the non-nipping state in which a gap is opened (see FIG. 4), and the user manually pulls the medium M out from the roll body 31 and inserts the leading end portion of the pulled out medium M into the gap of the roller pair 41.

When the first sensor 26 detects the leading edge of the medium M, the controller 100 controls the first motor 17, the second motor 18, the feeder 30 (the feed motor 34), the transport unit 40 (the transport motor 42), and the like so as to perform the medium setting assistance operation on the printing apparatus 11. More precisely, the controller 100 performs a medium setting assistance operation, which includes a skew correction operation.

In the medium setting assistance operation, when the first sensor 26 detects the medium M in the non-nipping state of the roller pair 41, the controller 100 drives the roller pair 41 to the nipping state such that a nipping operation is performed to nip the medium M. Then, following the nipping operation, the controller 100 controls the rotation of the roller pair 41 so as to transport the medium M downstream in the transport direction Y and to transport the medium M in the reverse direction or upstream in the transport direction Y, thus performing the skew correction operation. In one example, a sensor is provided to detect whether or not the roller pair 41 is in the non-nipping state or the nipping state. Such a sensor may, for example, detect the operation position of the operation lever 37, may detect the rotation angle of the first cam 65, or may detect the position of the following rollers 48.

Moreover, during printing or when replacing the roll body 31, for example, when the medium M is no longer present on the support unit 20 such that the first sensor 26 transitions from a detected state to a non-detected state, the controller 100 prepares for the user-performed medium setting operation by driving the second motor 18 and adjusting the pressing force of the roller pair 41 to the first pressing force N0 during the medium setting assistance operation. The controller may alternatively cause the roller pair 41 to be placed in the non-nipping state.

Figure 7:
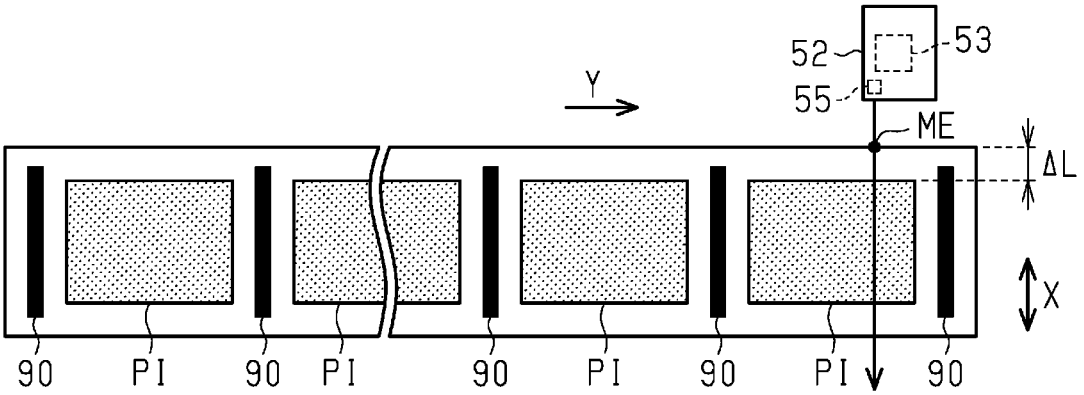
FIG. 7 is a schematic diagram illustrating a print pattern printed on a front face of a medium in double-sided printing.

Moreover, as illustrated in FIG. 7, when the printing apparatus 11 may perform double sided printing (e.g., printing on the front face or side and on the back face or side). During front face printing to print on the front face of the medium M, in addition to intermittently printing print images PI on the front face of the medium M along the transport direction Y, the printing apparatus 11 also prints marks 90 in front of and behind the print images PI in the transport direction Y. The marks 90 are, for example, printed in a color (for example, black or a dark color) contrasting in darkness to the color of the medium M (for example, white or a light color), and the marks 90 are configured as bars, in one embodiment extending along the width direction X intersecting the transport direction Y (namely the medium length direction). Note that the marks 90 are each set with a position, shape, and size detectable by the first sensor 26 during back face printing to print the back face of the medium M. The first sensor 26 of the present example is, for example, a non-contact sensor, configured by, for example, an optical sensor. As long as the first sensor 26 can at least detect the medium M, a contact sensor may, for example, also be employed therefor. In such cases, a separate mark detection sensor may be provided to detect the marks 90.

Next, when the printing apparatus 11 is printing the back face of the medium M, the first sensor 26 detects the marks 90 printed on the front face of the medium M, and determines the print positions to use on the back face so as to match the print images PI on the front face based on the positions of the marks 90 in the transport direction Y. Thus, the print images PI can be printed at positions on the back face of the medium M that match the print positions on the front face of the medium M. Note that in the present embodiment, the print images PI correspond to examples of printed regions.

Description will now be given regarding operation of the printing apparatus 11. The following description will focus on the medium setting assistance operation performed by the printing apparatus 11 when the user sets the medium M in the printing apparatus 11. While the power is switched ON to the printing apparatus 11, the controller 100 executes the program PR to control the medium setting assistance operation as illustrated in FIG. 8.

The medium setting operation to set the medium M to be printed in the printing apparatus 11 is performed manually by the user. The user first operates the operation lever 37 from the nip operation position to the release operation position. The release shaft 15 and the first cam 65 are rotated by operating the operation lever 37, and the roller pair 41 is opened as the following rollers 48 separate from the drive roller 46, thereby forming a gap between the rollers 46, 48. Next, the user pulls the medium M out from the roll body 31, and inserts the leading end portion of the pulled out medium M into the gap of the roller pair 41. Note that prior to the medium M being inserted into the gap of the roller pair 41, the medium M is not present on the support unit 20. Thus, the first sensor 26 is not detecting the medium M (negative determination at step S11). Based on the non-detection signal from the first sensor 26, the controller 100 adjusts the pressing force of the roller pair 41 to the first pressing force N0 (nip force) by driving the second motor 18 so as to change the rotation angle of the second cam 66 (step S12). Thus, when the user performs the medium M setting operation, the roller pair 41 is already adjusted to the first pressing force N0.

When the user inserts the leading end portion of the medium M pulled out from the roll body 31 into the gap of the roller pair 41, the first sensor 26 detects the inserted leading end portion of the medium M (affirmative determination at step S11). For example, when printing on the front face of the medium M, the first sensor 26 detects the leading end portion of the medium. Moreover, when printing on the back face of the medium M, the first sensor 26 detects either the leading end portion of the medium or the marks 90 applied to the medium M.

When the detection signal indicating that the medium M has been detected is input or received from the first sensor 26, the controller 100 nips the medium M with the roller pair 41 by driving the first motor 17 so as to switch the roller pair 41 from the non-nipping state to the nipping state (step S13). Then, when the second motor 18 is driven, the second cam 66 is rotated in the anti-clockwise direction of FIG. 4 so as to change from the released rotation angle illustrated in FIG. 3 to the nipping rotation angle illustrated in FIG. 4. As a result, the swing member 61 is swung about the support shaft 14 by the biasing force of the spring 73 in the anti-clockwise direction of FIG. 4, and the leading end portion of the medium M is nipped (gripped) by the roller pair 41 with the first pressing force N0 in accordance with the rotation angle of the second cam 66. In one example, the pressing force may vary according to the rotation angle of the second cam 66.

Next, the controller 100 drives the feed motor 34 and the transport motor 42 to perform a skew correcting operation. In the skew correcting operation, the controller 100 drives the feed motor 34 and the transport motor 42 to sequentially transport the medium M downstream in the transport direction Y, and to transport the medium M in a reverse direction or an upstream direction in the transport direction Y, so as to correct the skew (angle) of the medium M. Namely, in the skew correction operation, the controller 100 forward drives the feed motor 34 and the transport motor 42 to transport the medium downstream in the transport direction Y, and when, based on the detection signal of the rotary encoder 49, the transport distance (transport amount) of the medium M downstream by this transport process reaches a first distance, the controller 100 stops driving the two motors 34, 42, so as to stop transporting the medium M.

In this transport process, the controller 100 controls the speed of the feed motor 34 to have a slower transport speed than the transport speed with which the roller pair 41 transports the medium M due to the driving of the transport motor 42. As a result, back tension acts on the medium M due to the difference in transport speed of the medium M due to the two motors 34, 42. Any skew of the medium M is corrected by transporting the medium M over the first distance in the back tension applied state. When the skew correction operation has been completed, the controller 100 drives the feed motor 34 and the transport motor 42 in reverse so as to transport the medium M upstream in the transport direction Y. Thus, the medium M is reverse transported (back fed) upstream in the transport direction Y by reverse rotation of the drive roller 46 and the roll-form medium support 32.

In one example, the controller 100 drives the feed motor 34 and the transport motor 42 in reverse so as to reverse transport the medium M upstream in the transport direction Y, and when, based on the detection signal of the rotary encoder 35, the transport distance (transport amount) of the medium M toward the upstream side in this reverse transport process reaches a second distance, the controller 100 stops reverse transporting the medium M or stops transporting the medium M in the reverse direction. In cases in which, for example, back face printing is to be performed at this stage, after the medium M has been transported downstream in the transport direction Y in the skew correction operation, the controller 100 may determine a stop position for when the medium M is transported upstream in the transport direction Y based on the detection results of the first sensor 26 detecting the marks 90. In such cases, the second distance may be determined based on the results of detecting the mark 90 positioned at the beginning of the medium M. However, as long as the medium M can be stopped at the print start position at one of the marks 90 other than at the beginning, the second distance may be determined based on the results of detecting one of the marks 90 other than the mark 90 at the beginning. The medium M is accordingly disposed, for example, in the print start position.

Next, the controller 100 moves the carriage 52 in the scanning direction X and detects an edge position ME (see FIG. 7) of the medium M in the scanning direction X using the second sensor 55. The controller 100 acquires the position of the carriage 52 in the scanning direction X based on the detection signal of the linear encoder 54, and acquires the edge position ME of the medium M from the position of the carriage 52 when the second sensor 55 detects the edge of the medium M in the width direction X. The medium setting assistance control is ended when the above processing has been completed. Thus, the medium setting assistance control is configured to aid a user in that is manually setting the medium M into the transport device 25.

The controller 100 then drives a non-illustrated carriage motor to move the carriage 52 in the scanning direction X, and ejects ink from the liquid ejection section 53 toward the medium M as the carriage 52 is moving. Then, in cases in which the printing apparatus 11 is a serial printer as in the present example, the printing apparatus 11 prints the print images PI on the medium M by, substantially alternately, intermittently transporting the medium M and printing one line (one row) worth by ejecting ink. However, when the printing apparatus 11 is a line printer, the printing apparatus 11 prints the print images PI on the medium M by ejecting droplets for each whole individual line all at once from the liquid ejection section 53 toward the medium M, which is being transported at a constant speed.

In this printing process, the print position in the scanning direction X is determined based on the edge position ME of the medium M in the printing region PA detected during the medium setting assistance operation. For example, when the printing apparatus 11 is a serial printer, the printing images PI are printed by causing the carriage 52 to start scanning in the scanning direction from a predetermined position (for example, a home position) at the outside of the medium M, and by causing the liquid ejection section 53 to start ejecting ink from a print start position defined by a distance ΔL (see FIG. 7) with respect to the edge position ME of the medium M. Moreover, when the printing apparatus 11 is a line printer, the print images PI are printed by causing the liquid ejection section 53 to eject ink at print positions for each whole line as defined by the distance ΔL with respect to the edge position ME of the medium M. Note that when double-sided printing, the print images PI are printed together with the marks 90 illustrated in FIG. 7 at least when front face printing.

However, fine grooves or microscopic indentations and protrusions may be formed in the surface of the drive roller 46 in order to produce force to transport the medium M. Thus, if the user were to attempt to set the medium M manually, there would be a concern regarding the surface of the drive roller 46 being rubbed against and causing scratch damage or the like to the back face of the medium M in cases in which, for example, the medium M has been inserted into the gap of the roller pair 41 and the medium M has been pulled from the downstream side and has slid over the support unit 20. In contrast thereto, in the printing apparatus 11 of the present embodiment, the user only needs to insert the leading end portion of the medium M into the gap of the roller pair 41. When the leading end portion of the medium M is inserted as far as the position at which it can be detected by the first sensor 26, the medium M is nipped (gripped) by the roller pair 41, and the skew correction operation is performed on the medium M by rotating the roller pair 41 that has nipped the medium M. This thereby avoids fine scratch damage due to the medium M being pulled and rubbed against the fine grooves or indentations and protrusions on the surface of the drive roller 46. This enables the medium M to be set without being damaged.

Moreover, the medium setting assistance operation is performed using the first pressing force N0 (weak nipping) as the pressing force for the roller pair 41. The first pressing force N0 is less than the second pressing force N1 (strong nipping) employed when the printing unit 50 is printing. Thus, as well as being less liable to damage the medium M, the generation of creases is less liable to occur even when the medium M is a soft medium, such as cloth or the like, for example. Moreover, due to transport of the medium M being performed during printing at the second pressing force, which is larger than the first pressing force during the medium setting assistance operation, the medium M is not liable to slip relative to the rollers 46, 48 of the roller pair 41 during printing, and the precision of the feed position of the medium M is raised. The printing apparatus 11 is accordingly able to provide printed matter with high print quality.

Moreover, the printing apparatus 11 is able to perform double-sided printing. When double-sided printing is performed, in addition to printing the print images PI of images and text or the like on the front face of the medium M, the marks 90 are also printed on the front face of the medium M, in front of and behind the print images PI in the transport direction Y. In the printing apparatus 11, the medium M is reverse transported from the roll body 31 on the take-up side after printing has finished, taken up on the supply-side roll body 31 on the supply side, and replaced as the roll body 31 on the supply side. In such back face printing, similarly to in front face printing, for example, the medium setting assistance operation is performed when the user is performing the medium setting operation. Thus, even though the printing apparatus 11 employs the common printing unit 50 for both front face printing and back face printing, there is a need to perform the medium setting operation for both the front face printing and the back face printing. The burden of the medium setting operation is reduced by employing the medium setting assistance operation. Moreover, in comparison to a configuration such as for the printing device described in JP-A-2009-166403, which is provided with both a printing device for front face printing and a printing device for back face printing, the printing apparatus 11 suffices and is able to be more compact, enabling the installation space to be reduced.

Back face printing of the medium M is then started. During this, when the first sensor 26 detects the mark 90, the controller 100 uses the position of the mark 90 to ascertain the back face print position that corresponds to the front face print position. The controller then controls the transport unit 40 and the printing unit 50 so as to print at the back face print position. As a result, the back face images are printed on the back face of the medium M at positions aligned with the front images.

Moreover, even though the printing apparatus 11 handles large medium M and is comparatively large itself, the operation levers 37 enable the roller pair 41 to be opened or closed manually by a user and are provided on either side of the roller pair 41, at both the upstream side and the downstream side. Thus, after the medium M has been inserted into the gap of the roller pair 41 that was first placed in the release operation position by operating the operation lever 37 on the upstream side (rear side), the leading end portion of the medium M is then temporarily pressed by operating the operation lever 37 to the nip operation position. The user then moves to the front side of the printing apparatus 11, and, in addition to the gap of the roller pair 41 being opened by the user operating the operation lever 37 on the downstream side (front side) of the printing apparatus 11 to the release operation position, a lie adjustment operation is performed to stretch or otherwise arrange the medium M so as to lie straight out along the transport direction Y. The leading end portion of the medium M is detected by the first sensor 26, for example, in the lie adjustment operation.

Note that in the medium setting assistance operation, after the leading end portion of the medium M has been nipped by the roller pair 41 due to detection of or by the first sensor 26, the skew correction operation is not started in one embodiment. Instead a standby is adopted for the user to operate a switch 81 (FIG. 6). The skew correction operation is then started when the operation signal is input via the switch 81. By adopting such an approach, even after the medium M has been nipped by the roller pair 41 due to being detected by the first sensor 26, the user is still able to perform the lie adjustment operation as necessary to sort out the lie of the medium M while operating the operation lever 37 to the release position. Then when the lie adjustment operation has been completed, the user starts the skew correction operation by operating the switch 81.

According to the embodiment described above, the following advantageous effects can be obtained. (1) The printing apparatus 11 includes the transport unit 40 to transport the medium M nipped by the roller pair 41 in the transport direction Y, and includes the printing unit 50 that is positioned at the downstream side of the roller pair 41 in the transport direction Y and that prints on the medium M in the printing region PA. Moreover, the printing apparatus 11 includes the first sensor 26 positioned further downstream than the roller pair 41 in the transport direction Y as an example of a detection unit to detect the medium M using either the medium M or the mark 90 applied to the medium M as a detection target. Furthermore, the printing apparatus 11 includes the first motor 17 serving as an example of a drive unit capable of driving the roller pair 41 to both a non-nipping state, in which there is a gap open in the roller pair 41 such that the roller pair 41 is not able to nip the medium M, and to a nipping state, in which the roller pair 41 is able to nip the medium M. The printing apparatus 11 also includes the controller 100 that controls at least the transport unit 40 and the first motor 17 so as to perform the medium setting assistance operation to assist setting of the medium M in the transport unit 40. From the non-nipping state with the gap open in the roller pair 41, when the first sensor 26 has detected the medium M and the nipping operation has been performed to nip the medium M with the roller pair 41, the controller 100 performs the medium setting assistance operation including the skew correction operation in which the medium M is transported and reverse transported by the controller 100 controlling rotation of the roller pair 41. In addition to making the setting operation of the user to set the medium M in the roller pair 41 of the transport unit 40 easier, the setting operation can also be performed as a single sequence of operations as far as the skew correction operation on the medium M. As a result, for example, printing can be started soon after the medium setting operation.

(2) The printing apparatus 11 further includes the second sensor 55, which serves as an example of a second detection unit to detect the width direction X edge (end portion) of the medium M in the printing region PA. One or both edges of the medium in the width direction may be detected by the second sensor 55. The controller 100 detects the width direction X edge of the medium M using the second sensor 55 after the medium M has been transported upstream in the transport direction Y (namely, after the skew correction operation). The detection of the width direction X edge of the medium M is accordingly performed after the skew correction operation, enabling comparatively more accurate detection of the width direction X edge position ME of the medium M (the position of the end portion) during printing. For example, determining the print position for the printing unit 50 in the width direction X of the medium M based on the detected edge position ME enables printing to be performed with a comparatively high positional precision.

(3) Based on the edge position ME (position of the end portion) in the width direction X of the medium M as detected by the second sensor 55, the controller 100 determines an origin to determine the position in the width direction X of the printing region (print images PI) where the printing unit 50 prints on the medium M. This enables printing to be performed in the printing region with suppressed positional misalignment of the medium M in the width direction X, enabling printed matter of comparatively high quality to be obtained.

(4) After the medium M has been transported downstream in the transport direction Y in the skew correction operation, the controller 100 then determines a stop position for when the medium M is transported upstream in the transport direction Y based on the detection results of the first sensor 26 detecting the marks 90. For example, in a configuration in which the medium M is transported upstream until the end portion (leading end) of the medium M is detected, then there is a tendency for the medium M to be returned too far upstream, resulting in the amount to transport the medium M from the stop position of the medium M at this point to the print start position tending to be relatively large amount. In contrast thereto, when the above configuration is adopted, the stop position, for when the medium M is transported upstream in the transport direction Y, is determined based on the detection results of the marks 90. In other words, the stop position can be determined by detecting one of the marks. For example, after completing the skew correction operation, it is possible to avoid returning the medium M too far toward the upstream side and to also achieve a relatively small transport amount of the medium from the stop position to the print start position, or to eliminate this transport amount. This enables printing to be started comparatively soon after completing the skew correction operation.

(5) In the release shaft 15 of the operation lever 37, the end portion of the release shaft 15 further to the outside than the operation lever 37 is coupled to the first motor 17 through the electromagnetic clutch 38. The electromagnetic clutch 38 is accordingly normally in the disconnected state, and the electromagnetic clutch 38 is connected up when there is a need to drive the first motor 17 in order to drive the first cam 65. Namely, the controller 100 connects the electromagnetic clutch 38 when there is a need to drive the first motor 17, and disconnects the electromagnetic clutch 38 at other times. This enables the operation lever 37 to be operated with a comparatively light force.

Second Embodiment

Figure 9:
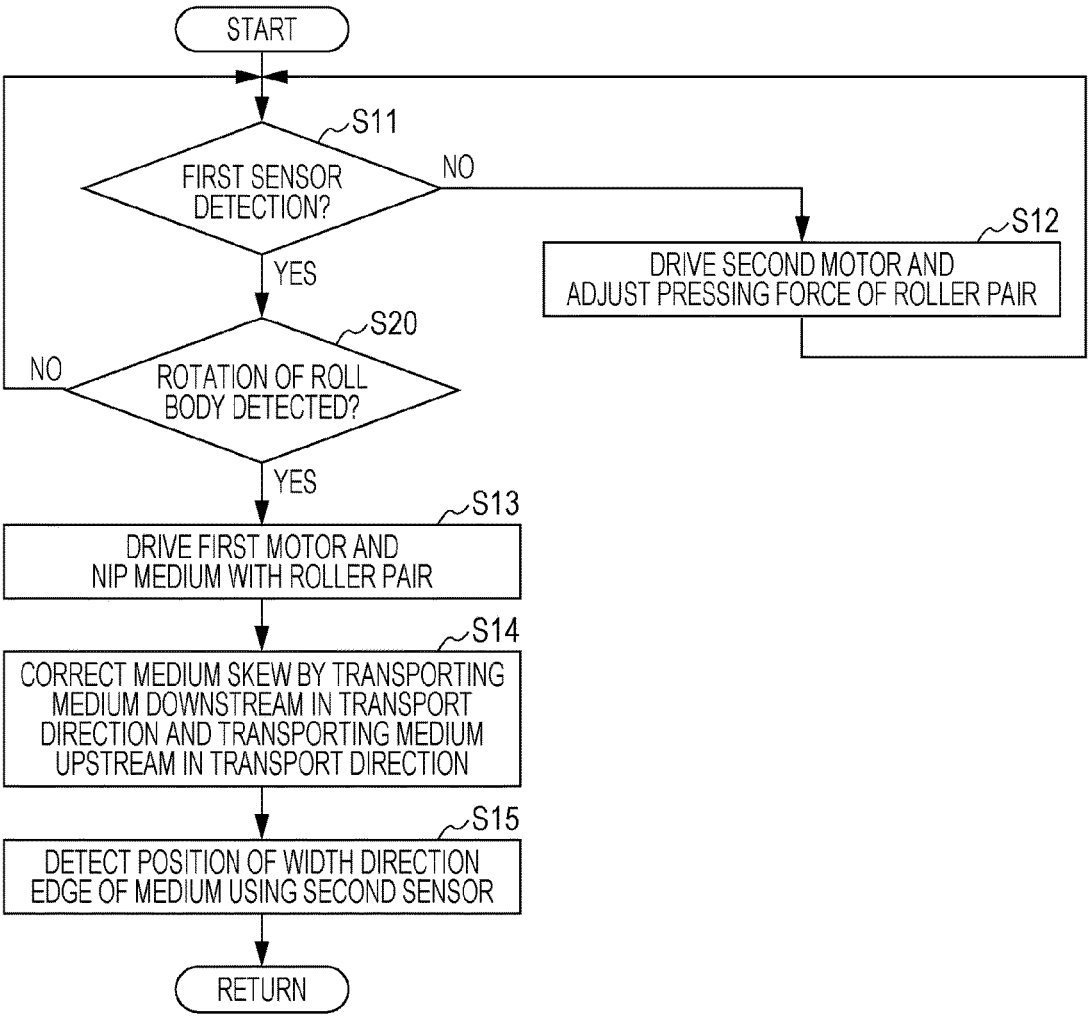
FIG. 9 is a flowchart illustrating another example of medium setting assistance operation control.

Next, description follows regarding a second embodiment, with reference to FIG. 9. In the second embodiment, part of the content of the control executed by the controller 100 in the medium setting assistance operation is different. Part of the configuration is similar to or the same as that of the first embodiment. From a power ON state of the printing apparatus 11, the controller 100 executes a program PR to control the medium setting assistance operation as illustrated in FIG. 9.

As illustrated in FIG. 9, when the first sensor 26 does not detect the medium (negative determination at step S11), the second motor 18 is driven, and the pressing force of the roller pair 41 is adjusted (step S12). For example, following the completion of printing the previous time, when the medium M to be printed is no longer present on the support unit 20, the pressing force of the roller pair 41 is adjusted to the first pressing force N0 in preparation for the medium setting assistance operation. Then, the user pulls the medium M from the replaced roll body 31, or from the re-wound roll body 31, and inserts the leading end portion of the pulled out medium M into the gap of the roller pair 41, which has been placed in the non-nipping state by advance operation of the operation lever 37 to the release position. When this has been performed, the medium M is detected by the first sensor 26 using either the inserted medium M or the marks 90 applied to the medium M as the detection target. In other words, the first sensor 26 detects the medium or the marks on the medium.

When the first sensor 26 has made a detection or detected that the medium has been inserted into the gap (affirmative determination at step S11), the controller 100 then determines whether or not rotation of the roll body 31 has been detected (step S20). For example, when the user starts to pull the medium M out from the roll body 31 in order to perform the medium setting operation, the roll body 31 and the roll-form medium support 32 start to rotate in the feed direction. The rotation of the roll body 31 and the roll-form medium support 32 is detected based on the detection signal of the rotary encoder 35.

In the second embodiment, when the two conditions of the medium M being detected by the first sensor 26 (affirmative determination at step S11) and rotation of the roll body 31 being detected by the rotary encoder 35 (affirmative determination at step S20) have been satisfied, the controller 100 takes this as meaning that the user has inserted the leading end portion of the medium M into the roller pair 41. Then when the two conditions of steps Sll and S20 are satisfied, the controller 100 starts the sequence of the medium setting assistance (steps S13 to S15).

There is, for example, a concern that the hand of the user might be detected by the first sensor 26 when the user is performing the medium setting operation in the vicinity of the roller pair 41. In such cases, although it is not possible to discern whether the object detected by the first sensor 26 is the medium M or a hand, when the object detected is the hand then rotation of the roll body 31 would not be detected. The medium setting assistance operation is accordingly not started when the first sensor 26 detects the hand of the user. However, the controller 100 detects rotation of the roll body 31 based on the detection signal of the rotary encoder 35 in cases in which the first sensor 26 is in a detecting state due to the user having inserted the leading end portion of the pulled out medium M into the gap of the roller pair 41 in the non-nipping state. Thus, introducing the presence or absence of rotation of the roll body 31 as a determination condition enables discrimination between cases in which the hand of the user has been detected by the first sensor 26, and cases in which the leading end portion of the medium M pulled out from the roll body 31 and inserted into the roller pair 41 by the user has been detected by the first sensor 26. The controller 100 is accordingly able to perform the medium setting assistance operation only in cases in which the leading end portion of the medium M has been inserted into the gap of the roller pair 41.

Note that the time at which rotation of the roll body 31 due to the medium M being pulled out by the user is detected, and the time at which the first sensor 26 senses the medium M due to the user inserting the leading end portion of the medium M into the gap of the roller pair 41 sometimes do not align with each other due to discrepancies in the timing of each action, slack in the medium M, or the like. Thus, when the timings associated with the detection by the first sensor 26 and the detection of rotation of the roll body 31 are, for example, within a range of a set period of time (for example, a range of from 0 seconds to 2 seconds), this may be taken as understanding that the determination conditions at steps S11 and S20 in FIG. 9 have been satisfied.

In addition to the advantageous effects (1) to (5) of the first embodiment, as described in detail above, the second embodiment is further able to obtain the following advantageous effect.

(6) In the second embodiment, the roll-form medium support 32 is capable of supporting the roll body 31 (roll-form medium) wound with the pre-printing medium M, and the controller 100 performs the medium setting assistance operation when the first sensor 26 detects the medium M or the marks 90 in a state in which the roll-form medium support 32 is rotated while the roller pair 41 is in the non-nipping state. Namely, the medium setting assistance operation is started using, as a trigger, the detection of the rotating state of the roll-form medium support 32 in addition to detection of the medium M or the marks 90 by the first sensor 26. Thus a situation can be avoided in which the medium setting assistance operation is started due to the user's hand or the like being mistakenly detected by the detection unit.

Third Embodiment

Figure 10:
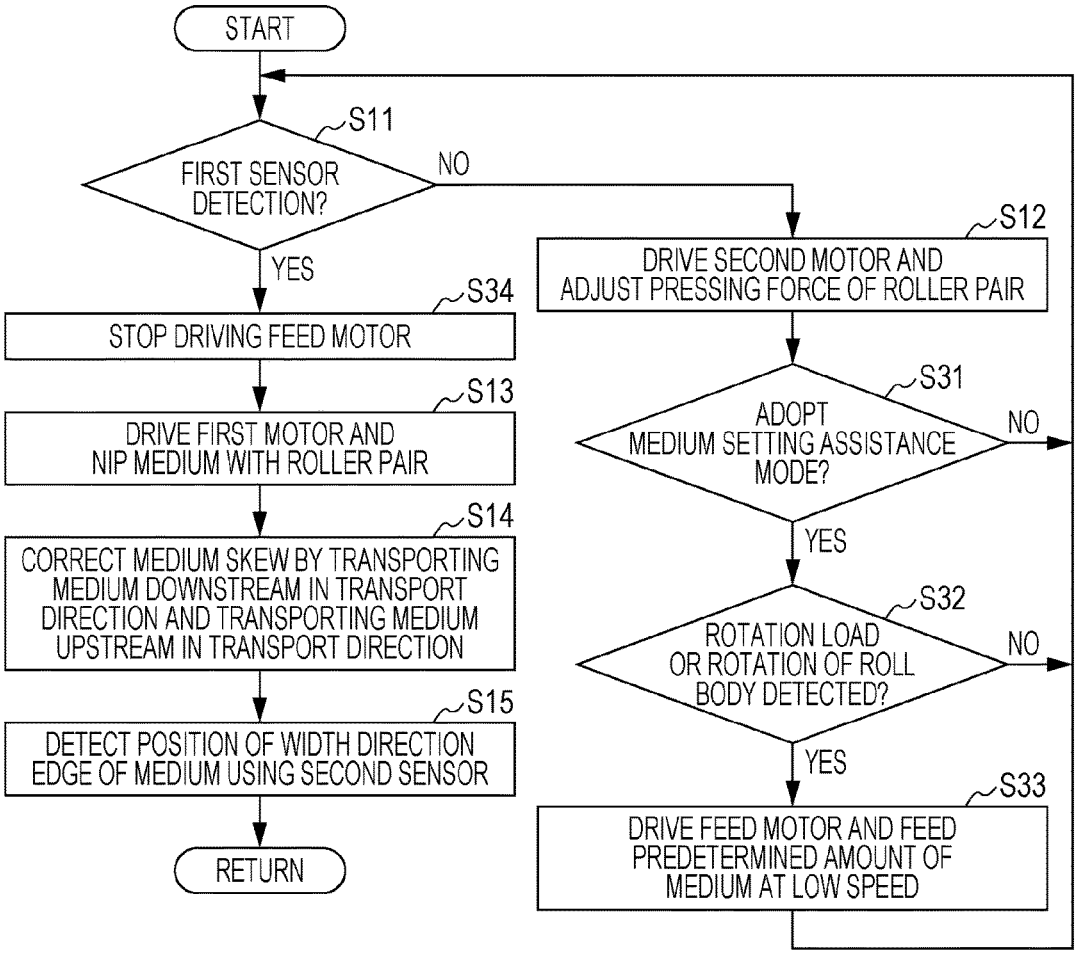
FIG. 10 is a flowchart illustrating another example of medium setting assistance operation control.

Next, description follows regarding the third embodiment, with reference to FIG. 10. In the third embodiment, part of the content of the control executed by the controller 100 in the medium setting assistance operation is different to that of the above embodiments. Other configurations or aspects of the third embodiments are similar to or the same as that of the first embodiment.

The printing apparatus 11 of the present embodiment includes a third sensor 39 serving as an example of a third detection unit as illustrated in FIG. 6. The third sensor 39 detects a load in the rotation direction (referred to below as a "rotation load") or rotation of the roll body 31. The third sensor 39 is configured to detect the rotation load of the roll body 31, and may be, for example, a sensor such as a torque sensor or a strain sensor that outputs a detection value according to the load (for example, the torque or the force) applied. The load (torque, for example) in the rotation direction (the feed direction in the present example) acting on the roll body 31 as the user tries to pull the medium M out from the roll body 31 is detected by the third sensor 39. When the detection value of the rotation load on the roll body 31 detected by the third sensor 39 exceeds a threshold value, the controller 100 feeds the medium M out from the roll body 31 by driving the feed motor 34, serving as an example of a drive source of the roll-form medium support 32, in a forward direction.

Moreover, in cases in which the third sensor 39 is configured to detect rotation of the roll body 31, for example, the rotary encoder 35 may be re-purposed as the third sensor 39. In such cases, when the roll body 31 starts to rotate in the feed direction as the user starts to pull the medium M out from the roll body 31, the controller 100 detects this rotation based on the detection signal of the rotary encoder 35 (the third sensor 39) with the feed motor 34 being in the non-driven state. When this occurs, the controller 100 feeds the medium M out from the roll body 31 by driving the feed motor 34 in the forward direction. Note that another sensor may be employed as the third sensor 39 as long as it is able to detect the rotation load or the rotation of the roll body 31 or the roll-form medium support 32.

Description now follows regarding operation of the printing apparatus 11, with reference to FIG. 10. As illustrated in FIG. 10, if the first sensor 26 does not detect the medium (negative determination at step S11), the second motor 18 is driven to adjust the pressing force of the roller pair 41 (step S12). The roller pair 41 is, for example, adjusted to the first pressing force N0 (<N1) weaker than the second pressing force N1 during printing operations.

The controller 100 then determines whether or not to adopt a medium setting assistance mode. In cases in which assistance is to be given to the medium setting operation in the printing apparatus 11, the user operates the switch 81 to instruct the printing apparatus 11 to perform the medium setting assistance operation to. When the controller 100 has received an instruction to perform the medium setting operation based on the operation signal from the switch 81, the controller 100 transitions from a normal mode to a medium setting assistance mode. The controller 100, for example, switches a value of a mode flag stored in a predetermined region of the non-volatile memory 104 from, for example, "0" to "1". However, when there is no need for the medium setting assistance operation, the user does not operate the switch 81 and the medium setting assistance mode is not selected. The normal mode is adopted in such cases. Processing returns to step S11 when the medium setting assistance mode is not to be adopted (namely, if the normal mode is to be adopted) (negative determination at step S31). However, when the medium setting assistance mode is to be adopted (affirmative determination at S31), the controller 100 determines whether or not rotation load or rotation of the roll body 31 has been detected (step S32).

Processing returns to step S11 unless a rotation load or rotation of the roll body 31 is detected (negative determination at S32). However, if a rotation load or rotation of the roll body 31 is detected (affirmative determination at S32), the controller 100 drives the feed motor 34 and feeds a predetermined amount of the medium M out at a low speed (step S33). For example, when the user starts to pull the leading end portion of the medium M out from the roll body 31 and the medium M is pulled lightly, a rotation load or rotation of the roll body 31 arises. When the rotation load or rotation of the roll body 31 is detected at this time (affirmative determination at S32), the medium M is fed out slowly from the roll body 31 by rotating the feed motor 34 slowly. A predetermined amount of the medium M required for insertion of the leading end portion of the medium M into the gap of the roller pair 41 is accordingly fed out automatically, even without the user pulling the medium M with a large force, or the roll body 31 being rotated in the feed direction by hand alone, thereby reducing the operational burden on the user of inserting the leading end portion of the medium M into the gap of the roller pair 41. Note that the reference here to "low speed" to indicate the feed speed of the medium M in the assistance operation means a speed that makes it easy for the user to set the medium M in the roller pair 41, and does not necessarily mean that the speed is slower than the medium speed during printing. Low speed is, for example, a speed that enables the feed amount (predetermined amount) of the medium M required for setting in the roller pair 41 to be fed out from the roll body 31 in a predetermined period of time within a range of, for example, 3 to 10 seconds.

Then, when the user has inserted the leading end portion of the medium M into the gap of the roller pair 41 and the leading end portion of the medium M is detected by the first sensor 26 (affirmative determination at step S11), the controller 100 stops driving the feed motor 34 (step S34). The feed motor 34 may stop in any event after a predetermined period of time. Following on therefrom, the controller 100 starts the medium setting assistance operation (steps S13 to S15). Note that after the medium M has been nipped (S13), the skew correction operation (S14) may be started when an instruction to start is given to the printing apparatus 11 by the user operating the switch 81. According to such a configuration, after the roller pair 41 has nipped the leading end portion of the medium M, the user may, as required, perform an operation to sort out the lie of the medium M prior to starting the skew correction operation. This enables the skew correction operation to be performed in the printing apparatus 11 at a timing when setting has proceeded up to the point at which the lie of the medium M has been sorted out. This enables the lie of the medium M after skew correction by the skew correction operation to be arranged in or placed in a better lie. As a result, the quality of printing performed on the medium M after the skew correction operation can be raised.

In addition to the advantageous effects (1) to (5) of the first embodiment, as described in detail above, the third embodiment is further able to obtain the following advantageous effect.

(7) In the third embodiment, the printing apparatus 11 includes the roll-form medium support 32 capable of supporting the roll body 31 wound with the pre-printing medium M. The printing apparatus also includes feed motor 34, which serves as an example of the drive source to rotate the roll-form medium support 32, and the third sensor 39, which is configured to detect a load in the rotation direction (rotation load) or rotation of the roll body 31. The controller 100 drives the feed motor 34 and feeds the medium M out from the roll body 31 when the third sensor 39 has detected the rotation load or rotation of the roll body 31 with the feed motor 34 in the non-driven state. Thus, even when the user pulls the medium M out from the roll body 31 in order to set the medium M in the roller pair 41, this operation to pull out the medium M is assisted by rotationally driving the roll-form medium support 32 in the feed direction, enabling the burden on the user to be reduced during the medium M setting operation.

Note that the following modifications may be made to the above embodiments.

In the third embodiment, in place of detecting the load in the rotation direction or the rotation of the roll body 31, the feed motor 34 may be rotationally driven in the direction to feed out the roll body 31 using operation of the switch 81 by the user as the trigger. For example, the operation to feed the medium M may be started using the operation of the switch 81 as the trigger. In such cases, the feed motor 34 is driven after a fixed period of time has elapsed from when the switch 81 was operated, enabling the user to be given preparation time before the leading end portion of the medium M is clamped. Thus, the switch 81 may include multiple switches, each configured to perform a different task in the setting operation (cause the roll body 31 to rotate, mode transition, skew operation start, etc.). Alternatively, a single switch may be used that has multiple positions. Alternatively, the input from the switch is interpreted based on the status of the assistance operation.

The skew correction operation may be performed by transporting the medium M while suctioning the medium M onto the support unit 20 by driving the suction mechanism 24. For example, the medium M may be nipped by the roller pair 41 by the controller 100 driving the first motor 17 and switching the roller pair 41 from the non-nipping state to the nipping state when the medium M is detected by the first sensor 26. Following on therefrom, the controller 100 controls driving of the feed motor 34 and the transport motor 42, and transports the medium M downstream in the transport direction Y. Next, the controller 100 drives the suction mechanism 24, and drives the first motor 17 to switch the roller pair 41 from the nipping state to the non-nipping state, and in this state transports the medium M upstream in the transport direction Y, while suctioning the medium M with the support unit 20. The skew of the medium M is corrected by this reverse transport process.

In the skew correction operation, to correct the skew of the medium M, it is sufficient to perform at least one process out of transporting the medium M downstream in the transport direction Y or reverse transporting of the medium M upstream in the transport direction Y. For example, the skew correction operation may be performed during reverse transport by engineering a difference in speed such that the transport speed of the feeder 30 is faster than the transport speed of the transport unit 40 during reverse transport of the medium M.

Although the following rollers 48 are arranged in a staggered array with the width direction X positions shifted between each of two rows at different positions in the transport direction Y, all of the following rollers 48 may be arranged in single row in which the following rollers 48 are arrayed in a single row.

The medium set in the roller pair 41 in the transport unit is not limited to being a roll-form medium, and a sheet medium, such as cut paper of a predetermined length, may be employed. For example, even for a sheet medium, if it is an elongated medium, having a medium setting assistance operation for setting the medium in the roller pair 41 would enable a comparatively simple medium setting operation by the user and enable the burden on the user to be reduced. Moreover, there is no limitation to an elongated medium, and application may be made to media of standard sizes such as A0 size, B0 size, and A4 size. In such cases, the printing apparatus may be one that does not include the holder 33 with the roll-form medium support 32, and is a printing apparatus not capable of using roll-form medium.

In the embodiments, the electromagnetic clutch 38 may be provided on the opposite side in the axial direction of the release shaft 15 to the operation lever 37 side. Moreover, the electromagnetic clutch 38 may be omitted. Namely, the output shaft of the first motor 17 and the release shaft 15 may be coupled together without doing so through an electromagnetic clutch.

In place of a configuration in which the first sensor 26 is embedded in the support unit 20 and detects the back face of the medium M, the first sensor 26 may be provided at a position enabling detection of the medium front face. For example, the first sensor 26 may be placed on the liquid ejection section 53 side (e.g. at the upper side) of the transport path of the medium M, or may be attached to the carriage 52.

The second cam 66 may be dispensed with, and the pressing force (nip force) of the roller pair 41 adjusted by adjusting the rotation angle of the first cam 65 in plural steps of three or more steps. Namely, pressing force may be set in one or more steps according to the rotation angle of the first cam 65 in a range between two operation positions of the operation lever 37 (the nipping position and the release position) when the roller pair 41 is opened or closed. In such a configuration too, in the assistance operation, the pressing force of the roller pair 41 may be adjusted in plural steps according to the type of the medium M. In such cases, the controller 100 does not control the second motor 18 when performing the assistance operation.

The modifier units 47 may be dispensed with, and the pressing force of the roller pair 41 when transporting the medium M may be made the same as that of the assistance operation or the printing operation.

In order to perform the assistance operation, the controller 100 may control at least the first motor 17 and the transport unit 40 (the transport motor 42). For example, if the medium is a sheet medium such as cutform paper, then the skew correction operation may be performed by transporting and reverse transporting the medium using only the drive control of the transport unit, without driving the feeder 30.

The control performed by the controller 100 of the printing device in the assistance operation may be realized by software through a computer executing a program, or may alternatively, for example, be realized by hardware through an electronic circuit (for example, a semiconductor integrated circuit) such as a field-programmable gate array (FPGA) or an Application Specific IC (ASIC), or may be realized by a cooperation of software and hardware.

The medium is not limited to paper, and may be a synthetic resin film or sheet, cloth, nonwoven fabric, metal foil, metal film, or the like.

The printing device is not limited to being a serial printer or a line printer, and may be a lateral printer in which a cartridge is capable of moving in two directions, a primary scanning direction and a secondary scanning direction.

Other than being an ink jet printer, the printing device may also be a dot impact printer, an electrophotographic printer, or a thermal transfer printer. Moreover, the printing device may be a 3D printer that forms three-dimensional objects by ejecting resin droplets onto a roll-form medium configured by a substrate.

What is claimed is:

1. A printing apparatus comprising:

a transport unit that transports a medium that is nipped by a roller pair in a transport direction;

a printing unit that prints on the medium at a position downstream of the roller pair in the transport direction;

a detection unit that detects the medium at a position downstream of the roller pair in the transport direction using either the medium or a mark applied to the medium as a detection target;

a drive unit that is capable of driving the roller pair to a non-nipping state in which there is a gap open in the roller pair and the roller pair is not capable of nipping the medium and to a nipping state in which the roller pair is capable of nipping the medium; and a controller that controls at least the transport unit and the drive unit so as to perform an assistance operation to assist setting of the medium in the transport unit, wherein the controller performs the assistance operation, wherein the assistance operation includes:

a nipping operation in which, from the non-nipping state of the roller pair, the detection unit detects the medium and the roller pair is driven to the nipping state to cause the medium to be nipped by the roller pair, and a skew correction operation following on from the nipping operation in which rotation of the roller pair is controlled such that the medium is transported downstream in the transport direction and such that the medium is transported upstream in the transport direction.

2. The printing apparatus of claim 1, further comprising:

in cases in which the detection unit includes a first detection unit, a second detection unit that detects a width direction end portion of the medium in a printing region, wherein the controller causes the width direction end portion of the medium to be detected by the second detection unit after the medium has been transported upstream in the transport direction.

3. The printing apparatus of claim 2, wherein, based on a position of the width direction end portion of the medium detected by the second detection unit, the controller determines a position in the width direction of a printing region where the printing unit will print on the medium.

4. The printing apparatus of claim 1, wherein after the medium has been transported downstream in the transport direction in the skew correction operation, the controller determines a stop position for the medium for when the medium is transported upstream in the transport direction based on a detection result in which the mark is detected by the detection unit.

5. The printing apparatus of claim 1, further comprising a roll-form medium support capable of supporting a roll-form medium wound with the medium, wherein the controller performs the assistance operation when the detection unit detects the medium or the mark in a state in which the roller pair is in the non-nipping state and the roll-form medium support is being rotated.

6. The printing apparatus of claim 1, further comprising:

a roll-form medium support capable of supporting a roll-form medium wound with the medium;

a drive source that rotates the roll-form medium support; and a third detection unit that detects a load in a rotation direction or rotation of the roll-form medium, wherein the controller drives the drive source to feed the medium out from the roll-form medium when the third detection unit detects the load in the rotation direction or the rotation of the roll-form medium while the drive source is in a non-driven state.

* * * * *